US005660334A

United States Patent [19]

Trusty et al.

[11] Patent Number: 5,660,334

[45] Date of Patent: Aug. 26, 1997

[54] REMOTE CONTROL FOR ELECTROSTATIC SPRAYER ELEMENTS

[75] Inventors: Dennis L. Trusty, Bismarck, N. Dak.; C. Ricky Heard, Dothan, Ala.

[73] Assignee: Clark Equipment Company, Woodcliff Lake, N.J.

[21] Appl. No.: 372,769

[22] Filed: Jan. 13, 1995

[51] Int. Cl.[6] ..... B05B 5/025; B05B 9/04

[52] U.S. Cl. ..... 239/691; 239/708; 239/148; 239/159; 239/172; 137/412

[58] Field of Search ..... 239/690, 691, 239/708, 148, 159, 172; 251/129.04; 137/412; 394/612, 618, 539, 500

[56] References Cited

U.S. PATENT DOCUMENTS

| | | | |
|---|---|---|---|
| 3,785,564 | 1/1974 | Baldocchi | 239/172 |
| 3,892,357 | 7/1975 | Tamny | 239/706 |
| 3,933,285 | 1/1976 | Wiggins | 239/3 X |
| 4,085,892 | 4/1978 | Dalton | 239/15 |
| 4,185,650 | 1/1980 | Neves et al. | 239/69 X |
| 4,216,915 | 8/1980 | Hengartner et al. | 239/698 |
| 4,553,702 | 11/1985 | Coffee et al. | 239/690 |
| 4,588,318 | 5/1986 | O'Brien et al. | 401/146 |
| 4,788,617 | 11/1988 | Davidson | 361/1 |
| 4,821,958 | 4/1989 | Shaffer | 239/131 |
| 4,827,395 | 5/1989 | Anders et al. | 364/138 |
| 5,218,305 | 6/1993 | Lunzer | 324/457 |
| 5,263,824 | 11/1993 | Waldbeser et al. | 251/129.04 X |
| 5,305,791 | 4/1994 | Kowalchuck | 251/129.04 X |
| 5,335,854 | 8/1994 | Seitz et al. | 239/708 X |
| 5,381,962 | 1/1995 | Teague | 239/526 |

FOREIGN PATENT DOCUMENTS

| | | | |
|---|---|---|---|
| 627454 | 9/1978 | U.S.S.R. | 137/412 |

*Primary Examiner*—Lesley D. Morris

*Attorney, Agent, or Firm*—Westman, Champlin & Kelly, P.A.

[57] ABSTRACT

An electrostatic spray system has a high voltage section where an electric charge is applied to a liquid and the high voltage section is isolated from a lower potential section, such as a frame. The spray system has components on the high voltage section that communicate for operating functions with other components on the low voltage section, such as a liquid level sensor that controls flow into a liquid reservoir or valves on the high voltage section controlled from the low voltage section. Radio controls are provided for the components so there are no physical links for the operation of the components that can provide current leakage paths back to ground.

6 Claims, 3 Drawing Sheets

56
LIQUID SOURCE
75
V
RECEIVER
A
116
120
54
61
61
62
60
58
57
64
50
68
66
72
70
67
46
109
73
72A
76
78
TRANSMITTER
111
45
86
44
79
40
80
BATTERY
M
42

REMOTE CONTROL FOR ELECTROSTATIC SPRAYER ELEMENTS

BACKGROUND OF THE INVENTION

The present invention relates to a system for providing an electrostatic charge on liquids to be applied to other objects utilizing remotely actuated components to help keep the high voltage equipment electrically isolated from low voltage supports.

Various electrostatic spray systems have been advanced for spraying materials. U.S. Pat. No. 4,788,617 discloses an electrostatic spray system which utilizes two containers, with liquid transfer between the containers. An electrostatic charge is applied to a liquid in one container and the liquid is then sprayed onto plants, for example. This device requires two closed tanks that are pressurized and requires control over the current flow between the tanks for operation.

However, this device, and other units, including various closed pressurized systems continue to face the problem of current leakage to ground and an important factor is that lines extend from three high voltage components to the low voltage supports. Paths for current leakage form, even when care is taken to insulate well.

SUMMARY OF THE INVENTION

The present invention relates to the use in an electrostatic spray system of small, commonly known transmitters and receivers for providing radio signals between low voltage or grounded regions, and the high voltage components of an electrostatic sprayer. The high voltage components are all placed on an isolated platform or support. The absence of conductors or wires that can cause current leakage back to low voltage environments, such as to ground, aids in maintaining a high level of electrostatic charge on liquid that is being sprayed. It has been found that one of the paths for current leakage back to ground is along control wires such as wires between a level sensor for a reservoir used and an actuator for a liquid supply valve that is opened and closed.

Additionally, where a valve manifold for distributing the charged liquid is provided on a high voltage platform, having valve control wires extending from the low voltage operator's control, the wires tend to form extra paths for current leakage.

The present invention involves the use of a transmitter or receiver component of a radio frequency controller mounted directly on the high voltage platform with a self-contained battery on the platform, to transmit or receive signals from or to a transmitter or receiver on the low voltage support. The remote, wireless controls are used to operate valves for controlling the liquid level in a liquid reservoir or container. The remote wireless controls also can be used for other controls or components in regard to the liquid supply to the electrostatic supply tank.

It is well known in model airplanes, cars, boats and the like that selected frequencies can be used for operating different actuators, such as forward, reverse, and turning airplanes, vehicles or boats. These receivers and transmitters are quite compact and small and require a low amount of power, but when used with suitable amplifiers can be used for operating valves or other actuators.

The operation of valves for controlling high voltage liquid flow from the low voltage platform can be accomplished by having a transmitter that the operator may operate to provide a radio frequency signal to a receiver on the high voltage component to turn on or turn off selected valves in a valve manifold used on the high voltage platform. These controls eliminate any physical connection between the platform and the low voltage supply.

DETAILED DESCRIPTION OF THE PREFERRED EMBODIMENTS

Figure 1:
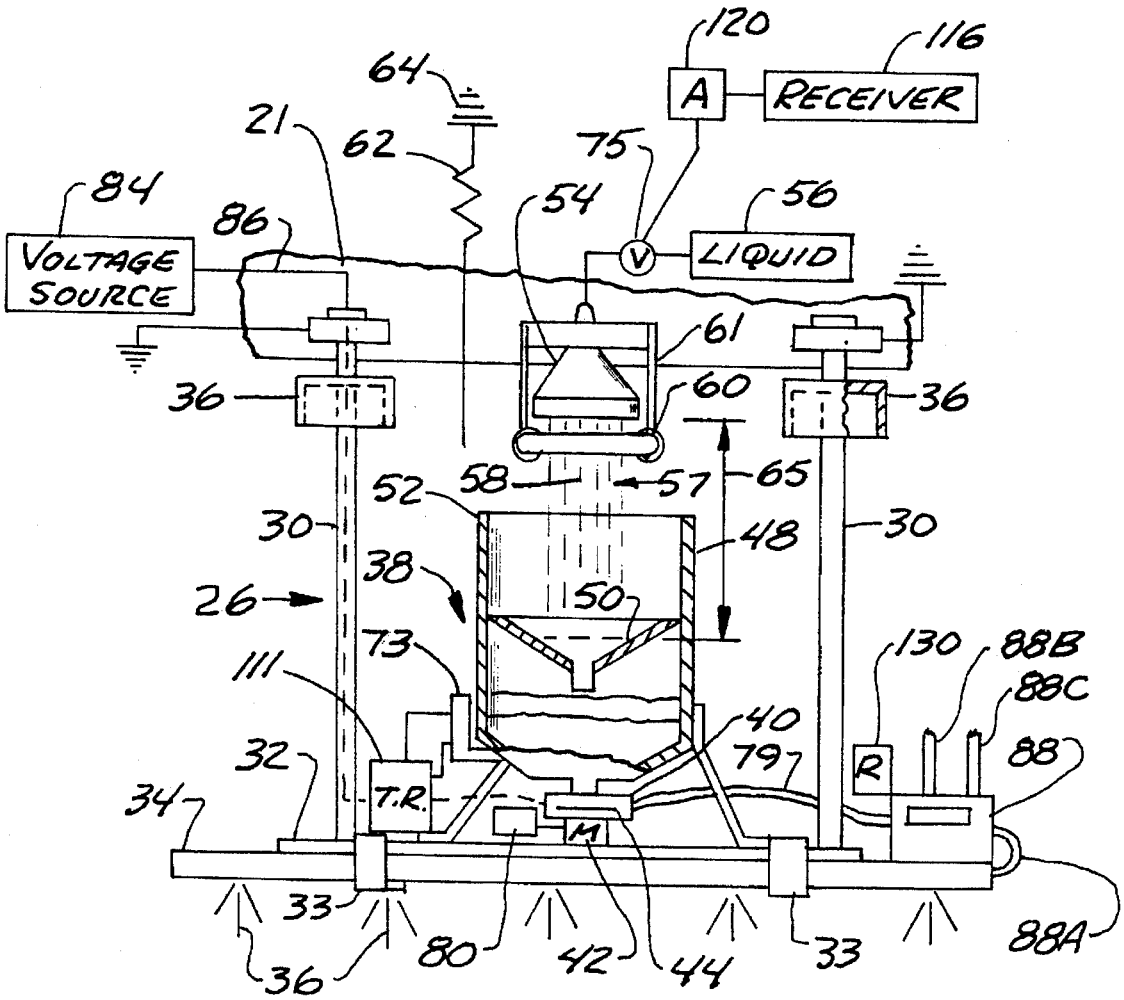
FIG. 1 is an elevational view of a typical electrostatic spray system made according to the present invention with parts broken away.

One of the problems that has consistently occurred in electrostatic spray systems is current leakage to ground, regardless of the type of system being utilized.

In the present-invention, a spray system is adapted for use in a wide variety of applications, including industrial applications such as spraying films on textiles, and other spraying operations. Additionally, coating agricultural crop seed with various films such as fertilizer, seed starter compounds and fumigants can be done with this type of a sprayer.

A further application is the use in connection with large field sprayers for applying herbicides to plants. When used for field spraying a self-propelled field sprayer travels over the ground and the electrostatically charged liquid is sprayed from nozzles.

A frame is used and supports an electrostatic high voltage component spray assembly indicated at 26. Arms 22 that are grounded or low voltage, are supported back to a frame 21. The spray assembly 26 is supported from arms 22 through suitable tubular insulating rods or isolators links 30. The insulating rods 30 can be made of tubular fiberglass or other suitable materials that are good insulators and they are used to support an insulating frame or support 32 in the form shown. The insulating frame 32 can take any desired configuration, and as shown the frame supports a center spray bar section 34 on which spray nozzles 36 are mounted with brackets 33.

To minimize migration of moisture back to the grounded arms 22 or other low voltage components, a pair of inverted insulating cups 36, 36 are supported on the pair of tubular rods or isolator links 30, and sealed tightly on the outer surfaces of the tubular rods 30, so that if moisture migrates along the rods, the moisture will be stopped by the insulating cup and will not cause a short or current conducting path back to the respective arms 22.

The frame or support 32 is used for supporting the high voltage components, including an open-top spray liquid container shown generally at 38, which is made in two sections. The spray liquid container 38 is suitably supported on the frame or support above a pump and motor assembly indicated at 40 which includes a drive motor 42 and a pump 44. A support for the container 38 is shown schematically and extends from the frame or support 32 to stabilize the spray liquid container 38. The liquid container 38 also is known as a charge tank and forms a reservoir to store a supply of liquid that is to be electrostatically charged.

The container 38 is made with a lower portion 46, and an upper portion 48, which is made in two sections. The upper portion 48 has a lower tapered funnel bottom section 50 and an upper cylindrical section 52.

A spray or sprinkler head 54 is mounted suitably onto an arm 28 that extends to frame 21 and provides a spray of conductive liquid from a pressurized source, such as a pump, indicated at 56, to cause a shower of liquid, usually water in the spray system shown, that is in the form of broken streams indicated at 58 to sprinkle into the open top of the spray liquid container 38. The sprinkles of water 58 pass through a guard ring 60, which, as shown is supported on insulated supports 61 to isolate it as fully as possible. The support 61 can be attached through isolating to the sprinkler head support arm 28. The ring 60 is electrically connected through a large resistor 62 to a low potential, for example ground 64. The use of the large resistor limits any current flow, but permits potential to drop to provide for in effect tending to constrict the width of the overall spray pattern shown at 57.

The distance from the sprinkler head 54 to the contact line on the funnel portion where the sprinkles of liquid contact the funnel portion 50, generally represented as a double arrow 65, is maintained sufficiently large so that the current leakage back to the shower head, which is connected to ground, is not significant. The streams of liquid in the spray 58 are maintained so that they are intermittent and do not form a direct conduit for current leakage back to the sprinkler head 54 and the liquid supply.

Figure 2:
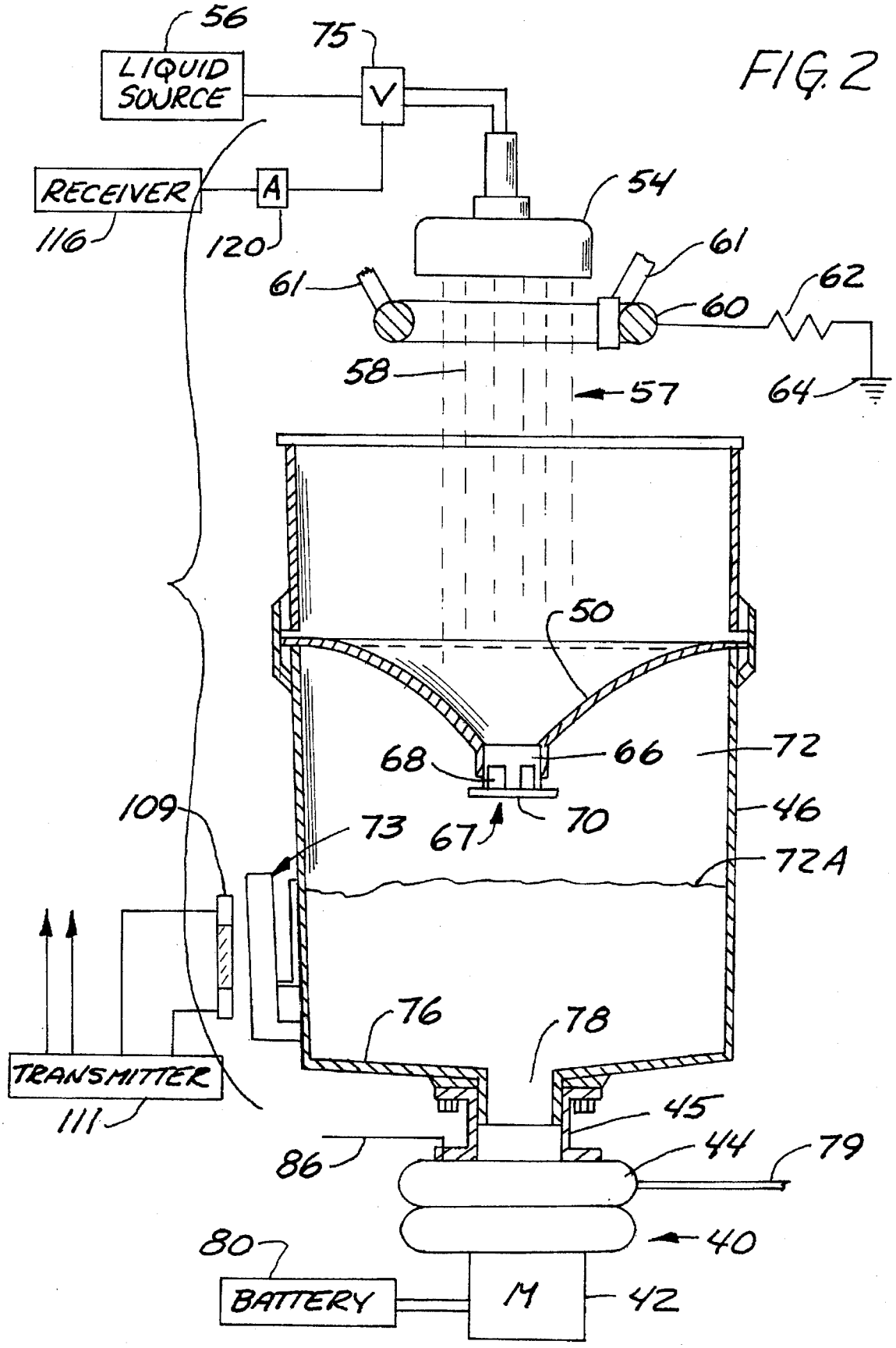
FIG. 2 is an enlarged sectional view of an open-top container used with the spray system of the present invention.

The funnel bottom 50 has an outlet opening provided with a splash guard 67, as shown perhaps best in FIG. 2, which leads to the lower container portion 46. The splash guard 67 is a cylindrical sleeve 66 that has a plurality of openings 68 in the sidewalls thereof, and a solid or imperforate plate 70 closing the bottom of the cylindrical sleeve 66. This means that liquid supplied from the sprinkler or shower head 54, has to pass through the cylindrical sleeve 66 and out the openings 68 to fill the interior chamber 72 of the lower portion 46 of the spray liquid container. The liquid establishes a level, depending on the rate of flow from the sprinkler head 54 and the rate that the liquid is removed. Either the input or removal rate can be adjusted but the level sensor 73 (FIG. 3) will be used to control a flow valve 75 to keep the level within set low and high limits in a conventional manner. The level sensor can be a magnetic float sensor, a compacitive sensor or other suitable sensor, and uses a transmitter and receiver arrangement for control, as will be explained. A typical level is shown at 72A. The splash guard 67 prevents water or other liquids used from splashing upwardly and out of the open-top container 38.

An outlet 78 from the liquid container 38 and in particular the lower section 46 is in the center of the bottom wall 76. The bottom wall 76 can be slightly curved down to the outlet 78. The pump 44 has an inlet pipe 45 connected to the outlet 78.

The pump 44 is driven by motor 42 to provide pressure in an outlet line 79. The motor 42 is a battery powered motor 42 as shown, which receives its power from a battery 80 on the platform 32. The motor could be a hydraulic motor that receives its power through hydraulic lines. Hydraulic lines are non-conductive, usually some synthetic elastomeric material reinforced with synthetic fibers, so the lines are electrical insulators. Hydraulic fluid, which is an oil, is also non-conductive so that there is no electrical conductive path from the power source used for driving the pump back to ground. A pneumatic motor also could be used.

A high voltage source (for example 20,000 to 60,000 volts) indicated generally at 84 is connected through a highly insulated line 86 to a metal or conductive housing of pump 44. At least one portion of the pump housing is made of an electrical conductor to provide a high voltage, low current input electrode to contact charge the liquid passing through the outlet 78 and into the pump 44.

The insulated high voltage line 86, as shown, passes through the center of one of the tubular insulating rods 30, as illustrated in FIG. 1, and then out through a small opening in the rod. The opening can be filled with a non-conductive putty or gasket material to seal the interior passageway of the tubular rod 30 from moisture. The line 86 can also be connected to an electrode in inlet pipe 45, in the lower portion of container 38, in valve manifold 88 or outlet line 79 where there is a constant flow of liquid.

Outlet line 79 carries charged liquid under pressure and connects to a manifold 88. The manifold in turn has valves that are controlled by radio frequency signals from a remote controller, to connect lines such as 88A to the spray bar 34, and thus to the nozzles 36, or valves can be selectively opened to lines 88B and 88C which go to other spray nozzles.

The pressure for the spray nozzles is provided directly from the pump 44, and the liquid is charged after it enters/contacts the liquid in container 38. The liquid in the container 38 also carries the charge. The operation of the motor for driving the pump, and the pump itself is carried out in a dry environment, that is, outside of the liquid container, and also the manifold valve is in a dry environment.

The pump is sealed relative to the liquid container 38, so that there is no liquid leakage to the exterior.

Mounting of the frame or support 32 onto insulator supports and mounting all of the high voltage components on the electrically isolated frame or support 32 minimizes current leakage and loss, which is one of the problems with electrostatic material handling. To eliminate further physical connections between the grounded and the high voltage components, radio frequency transmitters and receivers are used.

Figure 3A:
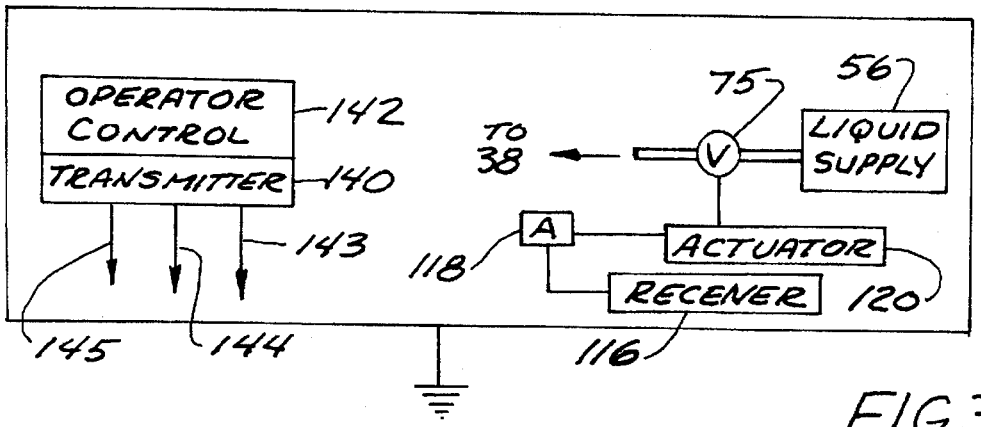
FIGS. 3A and 3B are block diagrams of the control system made according to the present invention including components on a low voltage support and on a high voltage support.
Figure 3B:
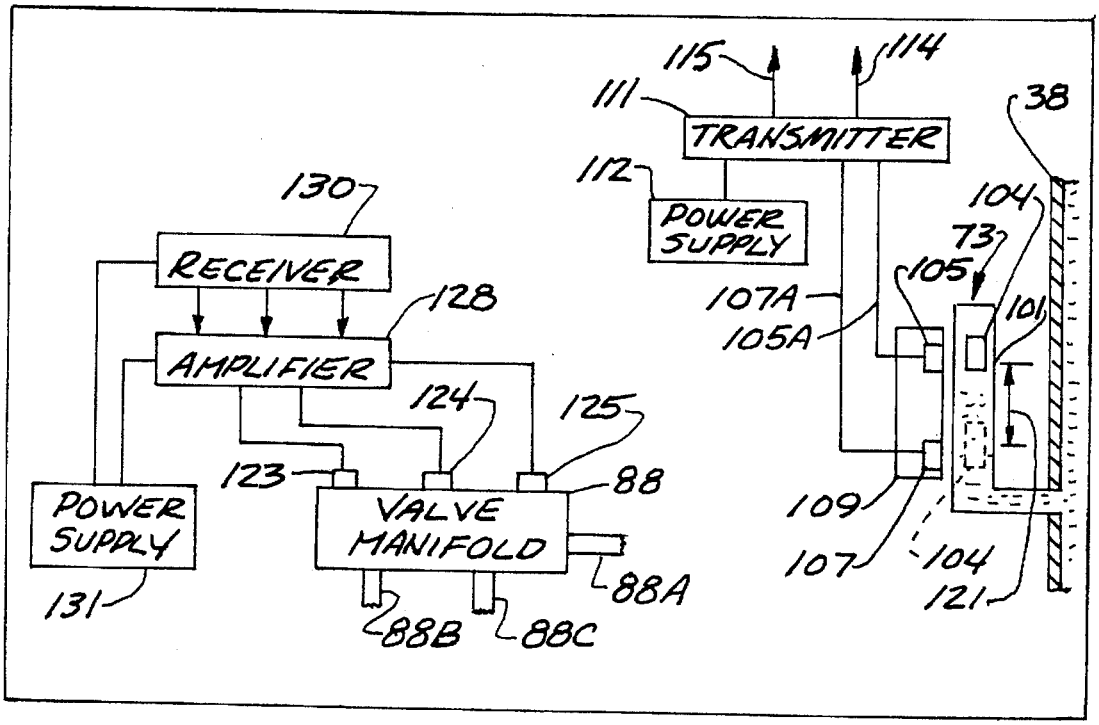

Referring to FIG. 3, a schematic representation of the control arrangement of the present invention is illustrated. The high voltage frame or support is represented at 100, and the level control shown generally at 73 is shown in greater detail and includes a tube indicated at 101 that is open to the lower part of container 38, and carries a float 104 with a magnet on the float. The float is shown in solid lines at 104, and is shown on dotted lines at the low level. The magnet on the float 104 is used to actuate one of a pair of switches 105 and 107 that are shown in a level sensor housing 109. The switches are of the type that can be actuated across a gap, such as magnetic operated switches, in turn will close or open to provide signals along lines 105A and 107A to a radio frequency transmitter section 111 of a radio frequency control link. The transmitter section 111 is powered from a power source mounted 112 which is mounted directly on the high voltage frame or support 32.

The signal on line 105A will cause the transmitter to transmit a signal at a first selected frequency represented by the arrow 114 and a radio frequency receiver section 116 is set to receive the first selected frequency and will output a signal in response. The receiver section 116 is mounted on the low voltage frame or support, such as the frame that mounts the high voltage frame or support 32. When the first selected frequency along line 114 is present, the output of the receiver section 111 will be amplified with an amplifier 118 to operate a solenoid actuator 120 that in turn operates the valve 75 controlling flow from the liquid supply 56. The signal from the switch 105 will cause the actuator 120 to close the valve 75 and shut off the flow indicating that the level in the container 38 is at a high level and that no more liquid should be introduced.

The liquid level is maintained within a range indicated generally by the double arrow 121 alongside the tube 101, and when the float drops below the upper indicator of the double arrow 121 the proximity switch 105 will be opened and the transmitted signal represented by arrow 114 will no longer be sent. This will relax the actuator 120 and the valve 75 will open, or if desired, a separate frequency signal could be sent from the transmitter section 111 to the receiver section 116 to control the state of the valve 75.

However, as shows, when the float in the tube 101 drops to its dotted line position, it will actuate a switch 107 which transmits a signal along line 107A to the transmitter section 111 which in turn would transmit a frequency represented by the arrow 115 to the receiver section 116 and this then would provide to turn the inlet valve on, and add additional liquid from the supply 56.

The signals from the receiver section 116 can be amplified in a suitable manner because there is adequate power on the low voltage environment. Other level control arrangements can be used, but the principal is to use a radio frequency transmitter on the high voltage frame or support a receiver section on the low voltage support that are not physically linked.

The valve manifold 88 can also be operated by radio frequency control, and electrically operated valves 123, 124 and 125 are illustrated on the manifold 88. The electric operators for the valves are connected through an amplifier 128 to a receiver section 130 of a radio frequency control link that is mounted on the high voltage platform represented by the block 100. The receiver section 130 is powered from a power source 131 also on the high voltage platform represented by the block 100.

The receiver section 130 is capable of receiving and identifying three different frequencies from a transmitter section 140 of the radio frequency control link. The receiver section 130 is controlled by an operator control 142. The three selected frequencies are represented by arrows 143, 144 and 145, and when the receiver section 130 receives a particular frequency as triggered by the transmitter section 140 responding to operator control 142, the appropriate signal corresponding to that frequency will be amplified to operate the associated one of the solenoid valves 123, 124 and 125. Again, the operator is on a low voltage support such as a vehicle or other support, and there is no physical connection for the operation of the valves of manifold 88 back to the low voltage support, thereby reducing the likelihood of current leakage that would be detrimental. The valves shown may be solenoid valves or valves having electric drive actions.

The transmitters and receivers again are standard items that are used in a wide variety of applications, and so long as they have selectable, discrete frequencies for transmission and reception, with adequate power for amplifying the signals to provide operation of various controls.

The transmitters and receivers can control flow, by transmitting flow rate signals from a frequency flow meter on the output side of the pump back to a computer on an operator's platform and the computer would transmit radio frequency signals back to a receiver controlling a flow control valve on the high voltage frame. Further, a transmitter could be used for remotely controlling motor 80, or an alternative power source, such as a small diesel engine. Control wires or links to many components on the high voltage frame thus can be eliminated.

The liquid container is not pressurized in the present invention, which eliminates the need for having an air pressure source connected to the wet tank. The arrangement shown keeps current leakage back to the shower head very low, generally 10 to 20 microamps.

The sprinkler head 54 can be mounted on the low voltage portion of the frame, as shown, and the distance from the charge container and/or the liquid made sufficient so that it will not cause current leakage. The high voltage source may be in the range of 40,000 volts. Current carried by the liquid is in the range of up to 500 microamps.

Although the present invention has been described with reference to preferred embodiments, workers skilled in the art will recognize that changes may be made in form and detail without departing from the spirit and scope of the invention.

What is claimed is:

1. An electrostatic spray system for spraying electrostatically charged liquids comprising a high voltage section including a container for supplying conductive liquid, a source of a high voltage for electrostatically charging the conductive liquid, a valve manifold having at least one electrically operated valve thereon coupled to the container for controlling dispensing of electrostatically charged liquid under pressure at a location remote from the high voltage section, a low voltage support including a source of liquid for the container and a control for controlling liquid flow from the low voltage support to the high voltage section, wherein the improvement comprises a radio frequency transmitter on the low voltage support, and a radio frequency receiver on the high voltage section, said radio frequency receiver being coupled to operate the at least one valve and the radio frequency transmitter being on the low voltage support under operator control for transmitting selecting frequencies to the radio frequency receiver for operating the at least one valve to control dispensing of electrostatically charged liquid.

2. The system of claim 1, wherein said radio frequency transmitter is a multiple frequency transmitter and the radio frequency receiver is a multiple frequency receiver.

3. The system of claim 1, wherein said radio frequency transmitter is powered by a power supply mounted on the high voltage section.

4. The system of claim 1, wherein a second radio frequency transmitter is mounted on the high voltage section and is powered from a power source on the high voltage section, said second radio frequency transmitter receiving input signals indicating the level of liquid in the container for the conductive liquid used in the electrostatic spray system and transmitting radio frequency signals to a second radio frequency receiver on the low voltage support, said second radio frequency receiver being coupled for controlling flow of liquid to the container.

5. The system of claim 4, wherein the there is a source of flow of liquid mounted on the low voltage support, a flow control valve for controlling the flow of liquid into the container on the high voltage section, a sensor for sensing changes in levels of liquid in said container to provide the input signals to the second radio frequency transmitter, the second radio frequency receiver being coupled to control the valve to adjust the flow of liquid into the container as a function of the signals indicating level to maintain the liquid at a desired level.

6. The system of claim 2, wherein the valve manifold has a plurality of electrically operated valves therein, each of said valves being operable in response to a different one of the multiple frequencies received by the multiple frequency receiver.

* * * * *